US005458329A

United States Patent [19]

Bushman et al

[11] Patent Number: 5,458,329

[45] Date of Patent: Oct. 17, 1995

[54] PLAY PROLATE SPHEROID GAME BALL

[76] Inventors: Earl K. Bushman, 131 McLaren St., Henderson, Nev. 89014; Dereck J. Gable; 7246 Avenida Alisima, Rancho Palos Verdes, CA. 90274 et al

[21] Appl. No.: 285,822

[22] Filed: Aug. 4, 1994

[51] Int. Cl.[6] ..... A63B 41/00

[52] U.S. Cl. ..... 273/65 EF; 273/65 EC; 273/DIG. 8

[58] Field of Search ..... 273/65 EF, 65 R, 273/65 EC, 65 ED, 65 EE, 65 EG, DIG. 8

[56] References Cited

U.S. PATENT DOCUMENTS

| | | | |
|---|---|---|---|
| 3,256,020 | 6/1966 | Smith | 273/65 EF |
| 3,884,466 | 5/1975 | MacDonald et al. | 273/65 EF X |
| 4,003,574 | 1/1977 | MacDonald et al. | 273/65 EF X |
| 4,133,528 | 1/1979 | Koblick | 273/65 EF |
| 4,736,948 | 4/1988 | Thomas | 273/65 EF |
| 5,000,451 | 3/1991 | MacDonald et al. | 273/65 EF X |
| 5,066,012 | 11/1991 | Stark | 273/65 EF |
| 5,123,645 | 6/1992 | MacDonald et al. | 273/65 EC |
| 5,269,514 | 12/1993 | Adler et al. | 273/65 EF |

*Primary Examiner*—George J. Marlo
*Attorney, Agent, or Firm*—Allen A. Dicke, Jr.

[57] ABSTRACT

The game ball is a prolate spheroid ball like an American football. It is of smaller size and lighter weight to be used by young people. The ball is characterized by a straight unobstructed cylindrical hole through the center. In one embodiment fins are provided on the outside to spin the ball. The fins are at an angle of 13 to 22 degrees to the ball's longitudinal axis and may be adjustable. In another embodiment, the ball may have axial or spiral holes therethrough radially outward from the center hole.

20 Claims, 2 Drawing Sheets

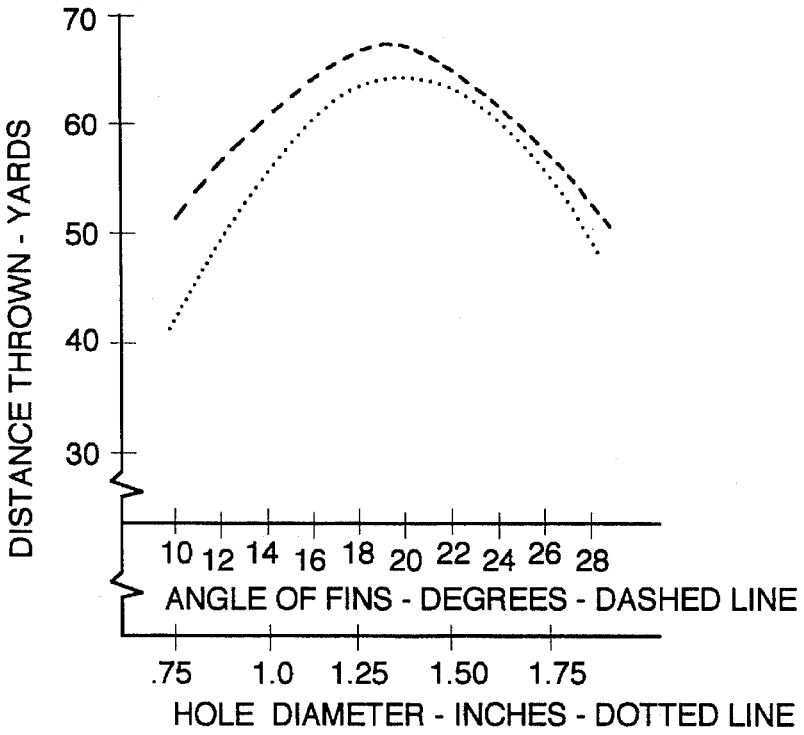
FIG. 2.
FIG. 3.
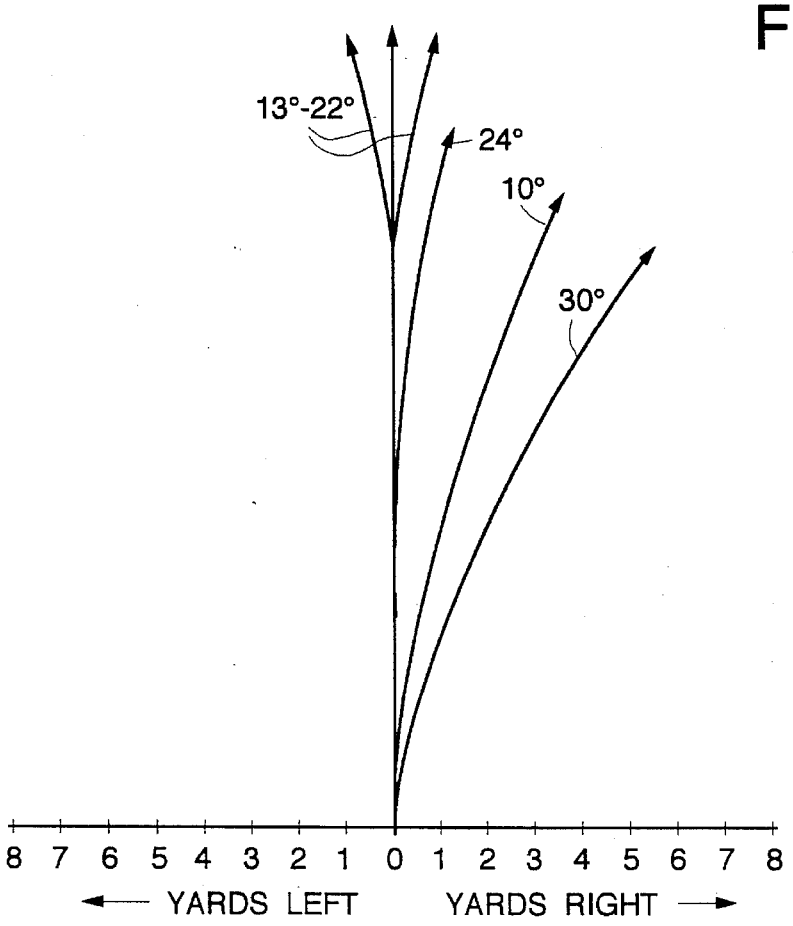

PLAY PROLATE SPHEROID GAME BALL

FIELD OF THE INVENTION

The play game ball of American football configuration and formed of lightweight materials has a straight central hole therethrough and has fins on the outside to spin the ball on its axis as it is thrown for enhanced accuracy and distance.

BACKGROUND OF THE INVENTION

The official prolate spheroid game ball used in American football is defined by a specific shape, weight and size. It is eminently suitable for the game of American football. However, as a ball for use by young people, it is too large and heavy. Additionally, its weight is such as to cause hurt if it strikes someone in an inappropriate manner.

To overcome these deficiencies, play game balls have been provided. These play game balls are made almost entirely of foam polymer composition material and are of about one-half to two-thirds the size of the standard American football. These are sometimes called "nerf" balls. The problem with these play balls is that they are too light to be thrown straight and for a substantial distance. It is undesirable to simply add weight because that increases cost and increases the chance of harm to a person who is struck by the ball. There is need for a ball with improved design which has better performance without significantly increasing the chance of harm.

SUMMARY OF THE INVENTION

In order to aid in the understanding of this invention, it can be stated in essentially summary form that it is directed to a play prolate spheroid game ball which is of light weight and which has a straight hole through the center thereof. Fins are provided on the outside of the ball to aid the ball in spinning about its long axis. The fin angle may be variable. In another configuration, generally longitudinal holes are positioned around the long axis central hole.

It is, thus, a purpose and advantage of this invention to provide a play prolate spheroid game ball which has improved characteristics with respect to the conventional foam plastic play ball.

It is a further purpose and advantage of this invention to provide an American football-shaped play ball which is of light weight so as to minimize the chance of hurt of one structure by the ball.

It is another purpose and advantage of this invention to provide a play ball of American football shape which has a central opening therethrough and fins thereon, both to provide rotational stability about the longitudinal axis.

It is a further purpose and advantage of this invention to provide a play ball of lighter size and weight, but proportioned like an American football wherein there is a plurality of generally longitudinal holes therethrough which may be parallel to the long axis of the ball to give the ball stability in flight when it is thrown axis-forward and spinning about the axis.

It is another purpose and advantage of this invention to provide a play ball of American football shape which has a central opening therethrough and fins thereon, both to provide rotational stability about the longitudinal axis.

Other purposes and advantages of this invention will become apparent from a study of the following portion of the specification, the claims and the attached drawings.

BRIEF DESCRIPTION OF THE DRAWINGS

FIG. 2 is a graph showing the distance the game ball of FIG. 1 can be thrown versus the angle of its fins and versus the interior hole diameter.

FIG. 3 is a graph showing the distance thrown and the straightness of travel of the ball for different fin angles.

DESCRIPTION OF THE PREFERRED EMBODIMENTS

Figure 1:
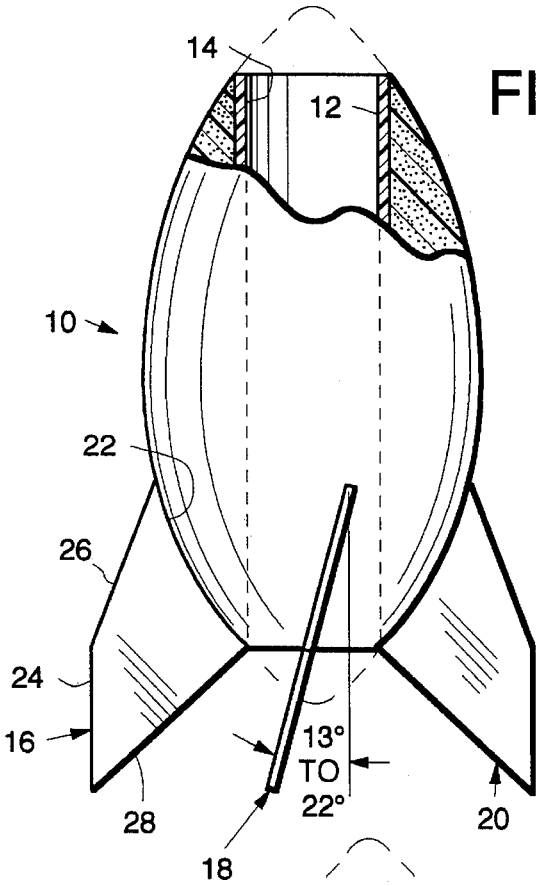
FIG. 1 is a side-elevational view, with parts broken away and parts taken in section of the first preferred embodiment of the play prolate spheroid game ball of this invention.

The first preferred embodiment of the play prolate spheroid game ball of this invention is generally indicated at 10 in FIG. 1. The game ball has an upright axis in FIG. 1, and this is the longitudinal axis about which the game ball spins when thrown. The prolate spheroid shape of the ball, to the dashed ends as if it had not been truncated, is about 9 inches in the full size play ball. The diameter across the long axis is about 5 inches in the play ball. These are about the same proportions as in the ball used in the game of American football. The ball 10 has an axial hole 12 of circular shape and uniform diameter through the length of the ball with the axis of the hole lying on the axis of the ball. The axial hole is lined with a tube 14 which adds some weight to the ball. The significance of the diameter of the hole through tube 14 is shown in FIG. 2. The optimum diameter for maximum distance thrown is about 1.375 inches. FIG. 2 illustrates that the ball can be thrown at least 55 yards with a hole diameter ranging in size from 1.00 inch to about 1.75 inches.

The ball 10 is fitted with exterior fins toward its rear. Three fins 16, 18 and 20 are shown. These fins are angled with respect to the axis so as to cause the ball to spin about its longitudinal axis when it is thrown. The fins are preferably flat panels of polymer composition material glued in place on the exterior of the ball just forward of its central opening. As is seen from FIG. 2, the ball 10 can be thrown more than 60 yards with a fin angle lying between 13 and 25 degrees. The optimum angle is about 19 degrees at which the ball can be thrown 67 yards. FIG. 2 relates the distance to the fin angle, and FIG. 3 relates the fin angle to the straightness of flight. FIG. 3 shows that, when the fin angle is 10 or 30 degrees, the ball 10 travels off of a straight line flight as well as losing distance. Even at 24 degrees fin angle, the distance thrown is shortened, as seen in FIG. 2, but the line of flight is closer to a straight line. When the fin angle is between 13 and 22 degrees, the line of flight is quite straight. Thus, from a distance and straightness viewpoint, a fin angle range of 13 to 22 degrees is satisfactory. Outside of that range, both distance and straightness significantly decrease. The data which is summarized by FIGS. 2 and 3 was collected as the results of a large number of test throws by boys in their low teen years. Older and stronger boys can throw the ball over 100 yards. The optimum ball has a 19 degree fin angle and a 1.37 inch hole diameter. The ball is weighted so that its center of gravity is 3/16 to 1/4 inch forward of the geometric center of the ball.

The fins are fairly rigid and can be fastened by any convenient means such as by adhesive attachment on the exterior. Three fins are shown, and they are attached at 120 degrees around the central axis. The fins are preferably each a polygon with the inner edge 22 shaped to fit the exterior surface of the ball just forward of its axial hole. The outer edge 24 is parallel to the axis. The forward edge 26 and rear edge 28 are angled rearwardly with respect to the axis. The ball 10 can be successfully thrown straight and for a long distance compared to a ball without the central hole and without the fins.

Figure 4:
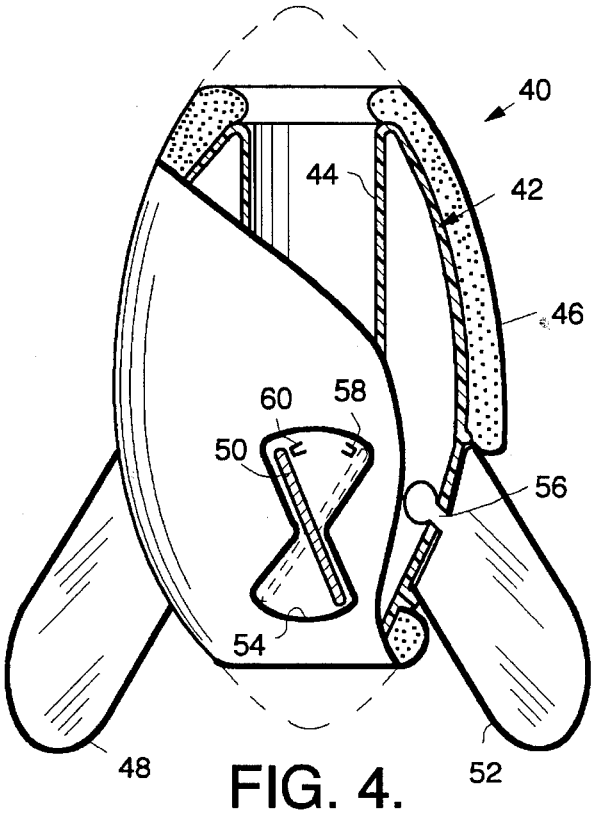
FIG. 4 is a side-elevational view, with parts broken away and parts taken in section of the second preferred embodiment of the game ball of this invention.

FIG. 4 shows a game ball 40, which is the second preferred embodiment of the game ball of this invention. The game ball 40 is formed as synthetic polymer composition material ball body 42 which may be blow-molded to shape. The blow-molding includes a central axial hole defined by tube wall 44. The hole thus defined is axial, is of circular section, and is of uniform diameter through the ball. Foamed polymer composition material cover 46 is placed over the ball body, such as by being formed in a mold in which the ball body is positioned. The game ball 40 is dimensionally similar to the game ball 10. Its center of gravity is forward of center, the same as for ball 10.

The game ball 40 is provided with at least three fins, equally angularly spaced around the axis. Three fins 48, 50 and 52 are shown spaced 120 degrees around the axis. Fin 50 is shown as broken away above its mounting. The fins 48, 50 and 52 are each rotatable on the ball body. The cover 46 has an opening at each fin with the opening 54 shown for fin 50. Each fin has a neck with a bulb thereon extending through an opening in the ball body. Neck 56 is shown with respect to fin 52. The neck is forced through an opening in the ball body so that the fin is retained. Each fin can be rotated within the limits imposed by opening 54. As previously described, the preferred fin angle is 19 degrees with respect to the axis, but a range of 13 to 22 degrees is acceptable. Tapered ramps 58 and 60 are formed on the blow-molded surface so that the edge of the fin can be snapped thereover to hold the fin at its end position. If desired, the fins can be moved to the angle shown in FIG. 4 to give the advantage of this ball configuration to left-handed throwers. For right-handed throwers, the fins would be rotated to engage behind stop 58 so that right-handed throwers can achieve the advantages of this ball configuration. If desired, a plurality of intermediate bumps could be provided to choose a different lesser fin angle than the preferred 19 degrees.

Figure 5:
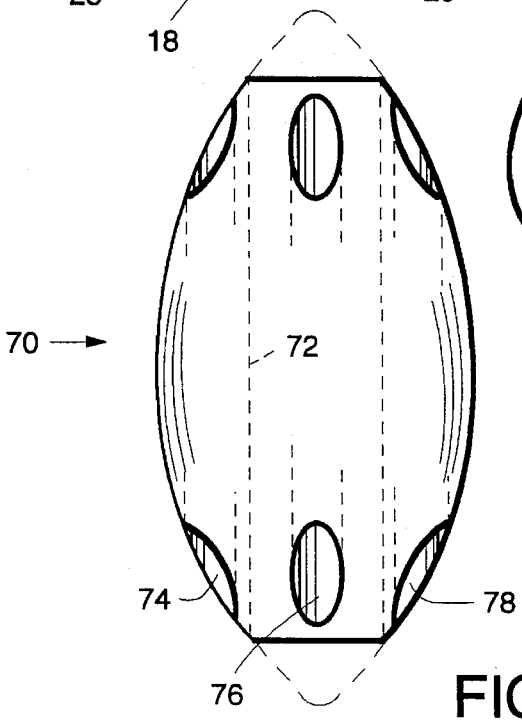
FIG. 5 is a side-elevational view of a third preferred embodiment of the game ball of this invention.

The third preferred embodiment of the game ball of this invention is generally indicated at 70 in FIG. 5. The ball 70 has the same exterior configuration as previously described with respect to the ball 10 and is of about the same size. Furthermore, the ball 70 has an axial straight circular central hole 72 therethrough. The hole is defined in size by the dotted line in FIG. 2, and is in the range of 1.00 inch to 1.75 inches. The optimum hole diameter is 1.37 inches. In addition to the central hole, the game ball 70 has four supplemental holes arranged therearound. In a preferred embodiment, these supplemental four holes each have a straight axis, and the axes are parallel to the axis of the central hole 70. Holes 74, 76 and 78 are indicated in FIG. 5. These holes are arranged in quadrature, and there is a hole on the far side similar to hole 76. The axes of these holes are equally spaced from the central axis. These supplemental holes are preferably about 0.75 inch in diameter, their axes are 1⅜ inches from the central axis, and are straight circular cylinders the same as the central hole 72. This configuration is preferred because it is easy to manufacture. It is also useful to configure the supplemental holes as straight, but angular to the central axis or to configure them as spiral at a uniform radius out from the central axis.

Tests were performed comparing the ball 70 of FIG. 5 with an identical ball without the four outer holes. The balls are weighted to weigh the same and were thrown by a plurality of different early teen young people. The ball with one hole traveled an average of 26⅔ yards, while the ball with five holes traveled an average of 29⅓ yards. Both balls were of the same weight and size. The ball with five holes was observed to spiral much more consistently and evenly. The ball with five holes may have traveled farther as a result of the smoother flight which resulted from the tighter spiral during the flight. Also, it is clear that the ball with the five holes presents less air resistance, and it appeared to travel slightly faster.

It is to be noted that the game ball 70 has all axial holes, with the axes parallel and the outer holes in quadrature to each other. More or less holes than four outer holes might be useful, but it would appear that three is a minimum number of holes to be effective, and more than about six holes cannot be installed while retaining adequate ball strength. The game ball 70 may be all foam polymer material; it may have a central tube therein, such as tube 14; and it may have a blow-molded body, such as the game ball 40, together with a foam polymer cover thereon.

The figures of the drawings show several different manners in which the ball can be manufactured. Any one of the configurations of the ball can be manufactured in any one of the different ways. The goal is to obtain a ball which is inexpensive of manufacture, of adequate of weight, and yet soft enough not to hurt a person it strikes. In the case where added weight is necessary to place the center of gravity forward of center, that additional weight should be interior of the ball so as not to affect the impact softness of the structure. In the structure of FIG. 1, the molded foam can be shaped so that the interior tube 12 does not quite extend to the end, thereby cushioning the end of the tube. Foam molding of the main body of the ball as in FIG. 1 is a convenient method of manufacture. Post molding work may include cutting the interior hole, or the hole can be molded followed by insertion of the interior tube 14. On the other hand, the foam can be molded around the tube. Other soft exterior material is useful. The interior shape can be manufactured by the previously noted methods or may be made by slush molding of thermosetting plastisol as another convenient manufacturing method.

This invention has been described in its presently contemplated best modes, and it is clear that it is susceptible to numerous modifications, modes and embodiments within the ability of those skilled in the art and without the exercise of the inventive faculty. Accordingly, the scope of this invention is defined by the scope of the following claims.

What is claimed is:

1. A play game ball comprising:

a body having a prolate spheroidal external surface, said body being at least partially formed of soft synthetic polymer composition material, said prolate spheroid external surface defining a longitudinal axis;

an unobstructed right circular cylindrical opening through said body, said cylindrical opening being defined by a right circular cylindrical wall about said axis, and said ball having in addition to said opening aerodynamic means for enhancing accuracy and distance resulting from manual throwing.

2. The ball of claim 1 wherein there are at least three fins externally mounted on said external surface of said body of said ball.

3. The ball of claim 2 wherein said fins are equi-angularly positioned on said body about said axis.

4. The ball of claim 3 wherein said fins are fixed on said ball and positioned at an angle between 13 and 22 degrees with respect to said axis.

5. The ball of claim 4 wherein said fins are positioned at the rear of said body and are attached to the exterior surface of said body adjacent said central opening.

6. The ball of claim 5 wherein said fins extend beyond said body of said ball behind said ball.

7. The ball of claim 3 wherein said fins are adjustable on said body.

8. The ball of claim 7 wherein said fins are adjustable from an angular position where they cause the ball to spin clockwise in flight to a position where they cause said ball to spin counter-clockwise in flight and said angular position is between 13 and 22 degrees with respect to said axis.

9. The ball of claim 1 wherein said body is foam synthetic polymer composition material and said central hole therethrough is defined by a polymer tube.

10. The ball of claim 1 wherein said ball is formed with a body of blow-molded synthetic polymer composition material including a wall defining said central opening and said blow-molded body is at least partially covered with synthetic polymer composition material.

11. The ball of claim 1 wherein said ball has a plurality of supplemental tubular unobstructed holes extending from one place on said external surface to another and spaced around said central hole, said supplemental holes being equi-angularly spaced around said axis.

12. The ball of claim 11 wherein said supplemental holes are right circular cylindrical holes of uniform diameter.

13. The ball of claim 12 wherein each of said supplementary holes has an axis and said axes of said supplementary holes being parallel to said axis of said central hole.

14. A play game ball comprising:

a prolate spheroidal body defining a longitudinal axis, said ball being at least partially formed of foam synthetic polymer composition material on the exterior surface thereof;

walls defining a central unobstructed opening through said ball, said walls defining a right circular cylindrical tube of uniform diameter having an axis on said ball axis, one end of said ball being the rear end thereof;

a plurality of fins mounted on said ball on the exterior of said ball at the rear end thereof, said fins being positioned at an angle with respect to said axis to aid in spinning of said ball as it is thrown.

15. The ball of claim 14 wherein said fins are positioned at an angle between 13 and 22 degrees with respect to said axis.

16. The ball of claim 15 wherein said fins are adjustably mounted on said ball, so as to be movable from a first end position to a second end position, said first end position being for clockwise spinning of said ball in flight and said second end being for the counter-clockwise spinning of said ball in flight, each of said end positions being at an angle between 13 and 22 degrees with respect to said axis.

17. A play prolate spheroidal game ball comprising:

a prolate spheroidal body having an external surface and having a longitudinal axis;

walls defining a central opening through said game ball, from said external surface at one end to said external surface at the other end, said central opening being a right circular cylindrical opening of uniform diameter having an axis lying on said ball axis; and a plurality of supplementary openings through said ball from said external surface at one end to said external surface at the other end, said supplementary openings lying substantially adjacent said central opening, said supplementary openings each being a right circular cylindrical tube of substantially uniform diameter, said supplementary openings being equi-angularly spaced around said central opening.

18. The ball of claim 17 wherein each of said supplementary openings is of the same diameter and each is of about one-half the diameter of said central opening.

19. The ball of claim 17 wherein each of said supplementary openings has an axis and said axes lie substantially parallel to said axis of said central opening.

20. The ball of claim 19 wherein each of said supplementary openings is of the same diameter and each is of about one-half the diameter of said central opening.

* * * * *